US008974019B2

(12) United States Patent
Sakamoto et al.

(10) Patent No.: US 8,974,019 B2
(45) Date of Patent: Mar. 10, 2015

(54) APPARATUS FOR AND METHOD OF SUPPLYING LIQUID

(71) Applicant: Dainippon Screen Mfg. Co., Ltd., Kyoto-shi, Kyoto (JP)

(72) Inventors: Takashi Sakamoto, Kyoto (JP); Satoshi Yasuda, Kyoto (JP); Masahiko Kakuda, Kyoto (JP); Takanori Tsuji, Kyoto (JP)

(73) Assignee: Dainippon Screen Mfg. Co., Ltd., Kyoto-Shi, Kyoto (JP)

( * ) Notice: Subject to any disclaimer, the term of this patent is extended or adjusted under 35 U.S.C. 154(b) by 0 days.

(21) Appl. No.: 14/223,584

(22) Filed: Mar. 24, 2014

(65) Prior Publication Data

US 2014/0285549 A1 Sep. 25, 2014

(30) Foreign Application Priority Data

Mar. 25, 2013 (JP) ..... 2013-061929

(51) Int. Cl.
*B41J 2/195* (2006.01)
*B41J 2/175* (2006.01)

(52) U.S. Cl.
CPC ..... *B41J 2/17566* (2013.01); *B41J 2/17596* (2013.01); *B41J 2002/17569* (2013.01)
USPC ..... 347/7

(58) Field of Classification Search
CPC . B41J 2/17566; B41J 2/17596; B41J 2/17569
USPC ..... 347/7, 8, 84, 85, 92
See application file for complete search history.

(56) References Cited

U.S. PATENT DOCUMENTS 3,787,882 A * 1/1974 Fillmore et al. ..... 347/6
8,256,855 B2 * 9/2012 Yamada ..... 347/7

FOREIGN PATENT DOCUMENTS

JP 2011189701 A 9/2011

* cited by examiner

*Primary Examiner* — Julian Huffman
(74) *Attorney, Agent, or Firm* — McDermott Will & Emery LLP

(57) ABSTRACT

A liquid supply apparatus includes a reservoir for storing a liquid therein, a supply path for supplying the liquid from the reservoir to a liquid consuming apparatus, a pump for feeding the liquid from the reservoir to the supply path, and a controller for outputting a driving signal to the pump to control the supply of the liquid. The controller acquires a target feed volume of the liquid from the pump to gradually change a feed volume of the liquid from the pump from a current feed volume to the target feed volume, based on a request signal from the liquid consuming apparatus serving as a destination to which the liquid is supplied. This suppresses an abrupt change in pressure in the liquid consuming apparatus serving as the destination to which the liquid is supplied.

15 Claims, 8 Drawing Sheets

FIG.7

111

| OUTPUT NUMBER | OFF TIME INTERVAL [ms] | ON TIME INTERVAL [ms] | DUTY RATIO |
|---|---|---|---|
| 0 | 10 | 0 | 0% |
| 1 | 9 | 1 | 10% |
| 2 | 8 | 2 | 20% |
| 3 | 7 | 3 | 30% |
| 4 | 6 | 4 | 40% |
| 5 | 5 | 5 | 50% |
| 6 | 4 | 6 | 60% |
| 7 | 3 | 7 | 70% |
| 8 | 2 | 8 | 80% |
| 9 | 1 | 9 | 90% |
| 10 | 0 | 10 | 100% |

APPARATUS FOR AND METHOD OF SUPPLYING LIQUID

BACKGROUND OF THE INVENTION

1. Field of the Invention

The present invention relates to an apparatus for and a method of supplying a liquid.

2. Description of the Background Art

A liquid supply apparatus for supplying a liquid through a liquid feed pipe has been hitherto known. A known example of the liquid supply apparatus includes an ink supply apparatus in which ink is supplied from an ink cartridge through a liquid feed tube to a head tank for supplying ink directly to an ink ejection head.

An inkjet recording apparatus including a conventional ink supply apparatus is disclosed, for example, in Japanese Patent Application Laid-Open No. 2011-189701. The inkjet recording apparatus disclosed in Japanese Patent Application Laid-Open No. 2011-189701 includes droplet ejection heads for ejecting ink, head tanks for supplying ink directly to the droplet ejection heads, ink cartridges for adding and supplying ink to the head tanks, and supply tubes for supplying ink from the ink cartridges to the head tanks (in paragraphs 0015 and 0031).

In such an inkjet recording apparatus, the ejection of appropriate amounts of ink droplets from the droplet ejection heads necessitates the adjustment of the pressure of ink in nozzles of the droplet ejection heads to within an appropriate range. The droplet ejection heads, on the other hand, are susceptible to the internal pressure in the head tanks (in paragraph 0003).

In such an ink supply apparatus for supplying ink from the ink cartridges to the head tanks, an abrupt change in ink supply volume causes an abrupt change in internal pressure in the head tanks. As a result, appropriate amounts of ink droplets cannot be ejected from the droplet ejection heads.

In particular, there are cases where a high-power pump is used for supply of ink in a large-scale inkjet printing machine which consumes a large amount of ink. Thus, large vibrations occur in some cases when the pump is turned on or off or when the output of the pump is changed. This results in apprehension that an abrupt change in internal pressure in the droplet ejection heads or the head tanks occurs to influence printing quality.

SUMMARY OF THE INVENTION

In view of the foregoing, it is an object of the present invention to provide an apparatus for and a method of supplying a liquid which are capable of suppressing an abrupt change in pressure in a destination to which the liquid is supplied.

A first aspect of the present invention is intended for a liquid supply apparatus for supplying a liquid to at least one liquid consuming apparatus. The liquid supply apparatus comprises: a reservoir for storing a liquid therein; a supply path for supplying the liquid from the reservoir to the liquid consuming apparatus; a pump for feeding the liquid from the reservoir to the supply path; and a controller for outputting a driving signal to the pump to control the supply of the liquid, the controller acquiring a target feed volume of the liquid from the pump to gradually change a feed volume of the liquid from the pump from a current feed volume to the target feed volume, based on a request signal from the liquid consuming apparatus.

According to the first aspect of the present invention, the liquid supply apparatus is capable of suppressing an abrupt change in pressure in the liquid consuming apparatus serving as the destination to which the liquid is supplied.

A second aspect of the present invention is intended for a method of supplying a liquid to a liquid consuming apparatus. The method comprising the steps of: a) providing a request signal from the liquid consuming apparatus to a controller which controls a pump for feeding a liquid stored in a reservoir to the liquid consuming apparatus; b) providing a target feed volume of the liquid from the pump, to the controller, based on the request signal; and c) outputting a driving signal from the controller to the pump, the driving signal gradually changing a feed volume of the liquid from the pump from a current feed volume to the target feed volume.

According to the second aspect of the present invention, the method is capable of suppressing an abrupt change in pressure in the liquid consuming apparatus which is a destination to which the liquid is supplied.

These and other objects, features, aspects and advantages of the present invention will become more apparent from the following detailed description of the present invention when taken in conjunction with the accompanying drawings.

BRIEF DESCRIPTION OF THE DRAWINGS

FIG. 7 shows a correspondence table between the output number of the driving signal and a duty ratio.

DESCRIPTION OF THE PREFERRED EMBODIMENTS

A preferred embodiment according to the present invention will now be described with reference to the drawings.

1. Liquid Supply Apparatus According to One Preferred Embodiment

<1-1. Configuration of Liquid Supply Apparatus>

Figure 1:
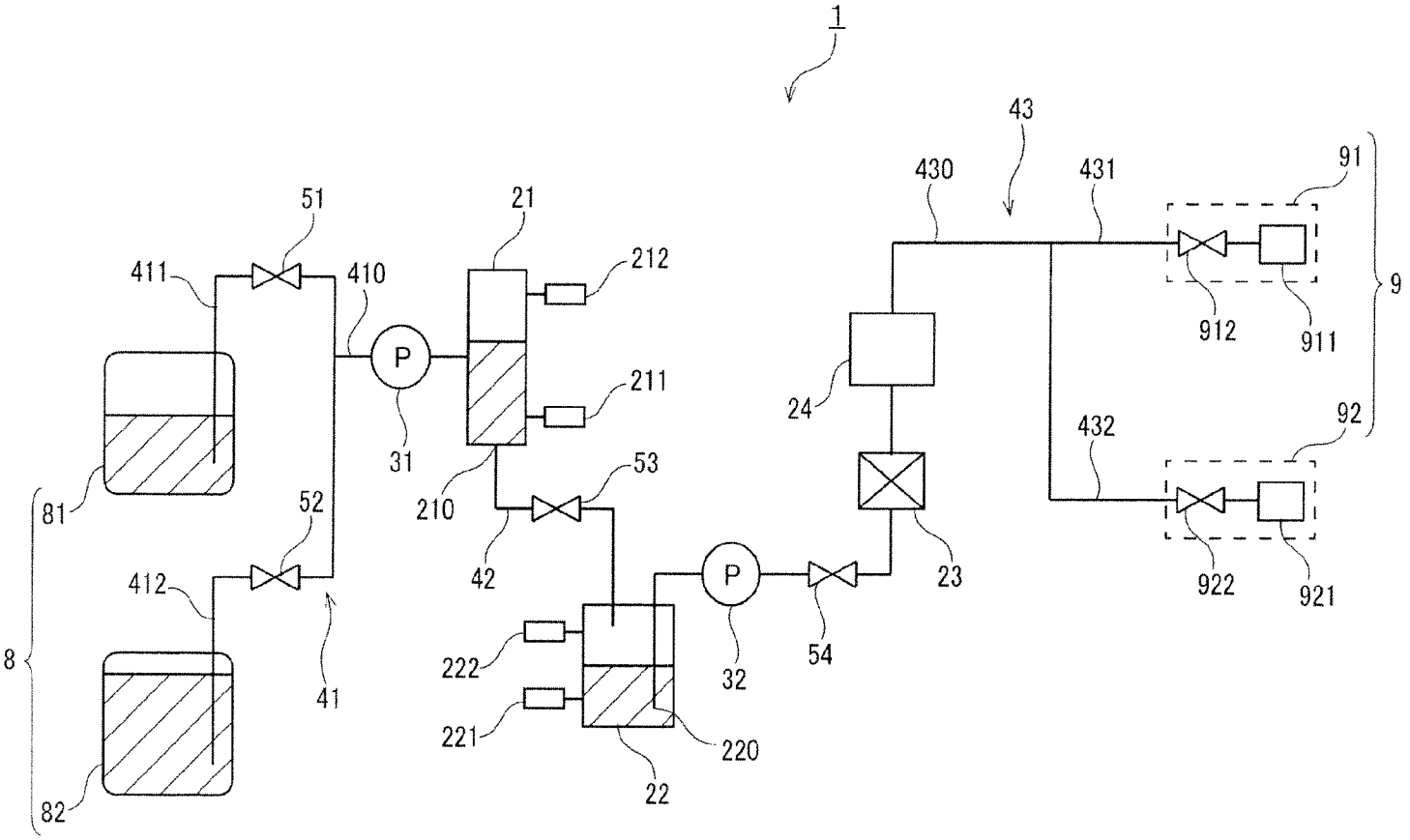
FIG. 1 is a diagram showing a configuration of a liquid supply apparatus.
Figure 2:
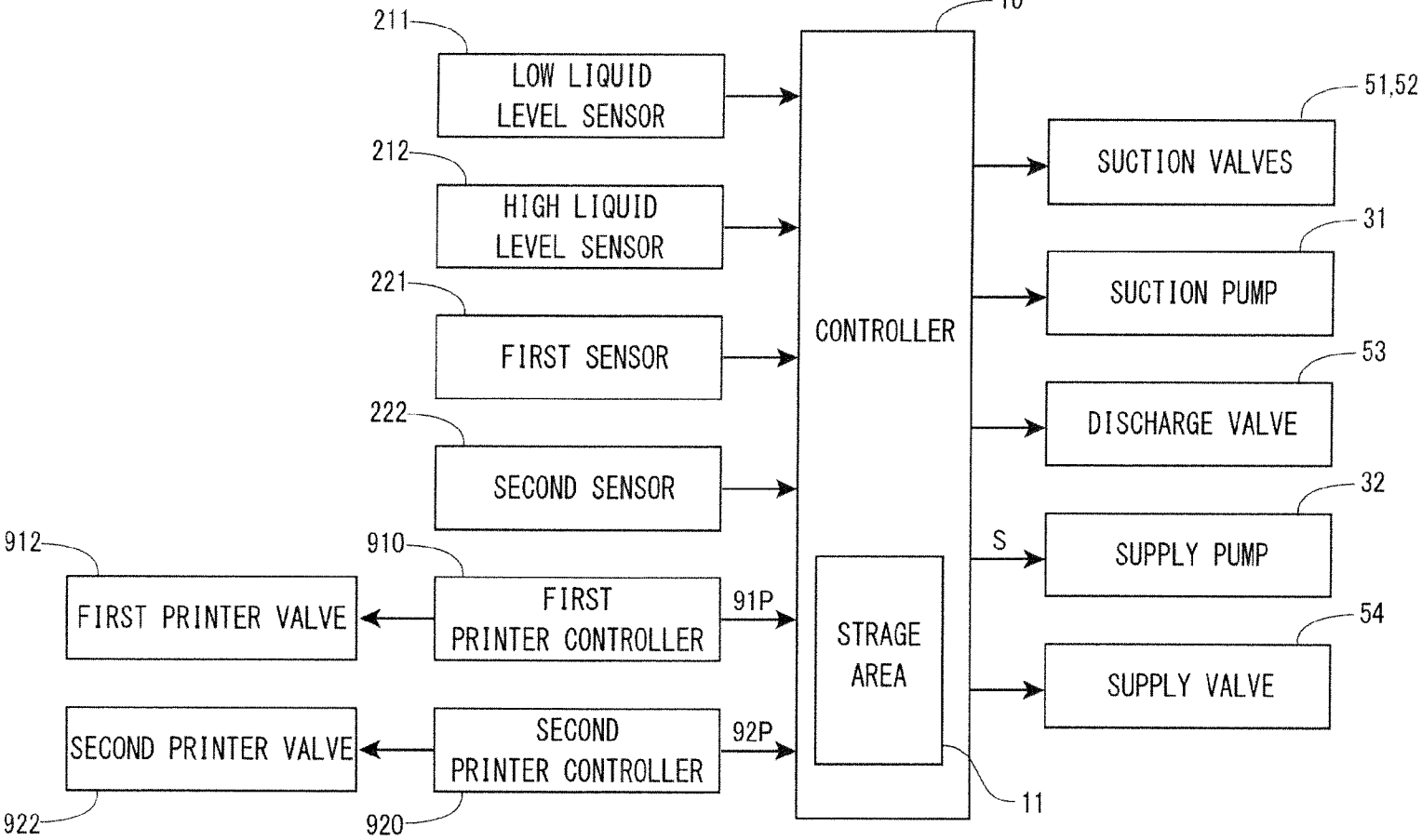
FIG. 2 is a block diagram showing a main control mechanism in the liquid supply apparatus shown in FIG. 1.

FIG. 1 is a diagram showing a configuration of a liquid supply apparatus 1 according to one preferred embodiment of the present invention. FIG. 2 is a block diagram showing a main control mechanism in the liquid supply apparatus 1. The liquid supply apparatus 1 is an apparatus for supplying ink from at least one ink tank 8 to at least one printer 9 that is an inkjet printing machine. The "liquid" which the liquid supply apparatus 1 according to the present preferred embodiment supplies is ink.

In the liquid supply apparatus 1 according to the present preferred embodiment, ink is supplied from two ink tanks 8 which are more specifically referred to as a first ink tank 81 and a second ink tank 82. In the liquid supply apparatus 1 according to the present preferred embodiment, ink is supplied to two printers 9 which are more specifically referred to as a first printer 91 and a second printer 92. In the present preferred embodiment, the at least one ink tank 8 serves as a "supply tank" and the at least one printer 9 serves as a "liquid consuming apparatus". The number of ink tanks 8 may be one or greater than two. Likewise, the number of printers 9 may be one or greater than two.

The liquid supply apparatus 1 includes a counting tank 21, an intermediate tank 22, a filter 23, a deaeration module 24, a suction pump 31, and a supply pump 32. As shown in FIG. 1, the aforementioned components 21, 22, 23, 24, 31 and 32 are connected through pipes 41 to 43. The counting tank 21, the intermediate tank 22, the deaeration module 24, the suction pump 31 and the supply pump 32 are controlled by a controller 10.

The counting tank 21 is a container which measures the volume of ink supply from the at least one ink tank 8 to the intermediate tank 22 to thereby manage the feed volume of ink. The counting tank 21 includes a low liquid level sensor 211 and a high liquid level sensor 212 both of which sense the liquid level of ink stored in the counting tank 21. The low liquid level sensor 211 senses whether the liquid level of ink in the counting tank 21 is higher than a predetermined first vertical position or not. The first vertical position is a position higher than an ink discharge port 210 provided in the counting tank 21. The high liquid level sensor 212 senses whether the liquid level of ink in the counting tank 21 is higher than a predetermined second vertical position or not. The second vertical position is a position higher than the first vertical position. In other words, the high liquid level sensor 212 is provided at a position higher than that of the low liquid level sensor 211. The measurement of the volume of ink in the counting tank 21 will be described later.

The intermediate tank 22 is a container for temporarily storing therein ink that is a liquid. In the present preferred embodiment, the intermediate tank 22 serves as a "reservoir". The intermediate tank 22 includes a first sensor 221 and a second sensor 222 both of which sense the liquid level of ink stored in the intermediate tank 22. The first sensor 221 is provided at a position higher than that of an ink discharge port 220 provided in the intermediate tank 22. The second sensor 222 is provided at a position higher than that of the first sensor 221. Preferably, there is a greater difference in height between the first sensor 221 and the second sensor 222.

The filter 23 is a filter for removing foreign matter from ink passing through the pipe 43.

The deaeration module 24 is a container for removing dissolved gases from ink. The deaeration module 24 includes, for example, a vacuum pump for exhausting gases from the interior of the deaeration module 24. The deaeration module 24 may have other structures capable of removing dissolved gases from ink. When the ink in the at least one ink tank 8 is deaerated ink, the deaeration module 24 may be dispensed with.

The suction pump 31 is a pump for sucking ink from the at least one ink tank 8 to supply the ink to the counting tank 21. The suction pump 31 is interposed in the pipe 41 which connects the at least one ink tank 8 and the counting tank 21 for communication therebetween. In the present preferred embodiment, the suction pump 31 serves as a "first feeding part" for feeding ink from the at least one ink tank 8 to the counting tank 21.

The supply pump 32 is a pump for sucking ink from the intermediate tank 22 to supply the ink through the deaeration module 24 to the at least one printer 9. The supply pump 32 is interposed in the pipe 43 which connects the intermediate tank 22 and the at least one printer 9 for communication therebetween. In the present preferred embodiment, the supply pump 32 serves as a "pump" for feeding ink from the intermediate tank 22 to the pipe 43.

The pipe 41 connects the at least one ink tank 8 and the counting tank 21 for communication therebetween. In the present preferred embodiment, two ink tanks, i.e. the first ink tank 81 and the second ink tank 82, are used as the at least one ink tank 8, as mentioned above. Accordingly, the pipe 41 includes a pipe 410 which connects to the counting tank 21 and in which the suction pump 31 is interposed, a pipe 411 which connects the pipe 410 and the first ink tank 81 to each other, and a pipe 412 which connects the pipe 410 and the second ink tank 82 to each other. Suction valves 51 and 52 that are on-off valves are provided in the pipes 411 and 412, respectively.

The pipe 42 connects the counting tank 21 and the intermediate tank 22 for communication therebetween. An end of the pipe 42 which is closer to the counting tank 21 is connected to the discharge port 210 of the counting tank 21. A discharge valve 53 that is an on-off valve is provided in the pipe 42. In the present preferred embodiment, the discharge valve 53 serves as a "second feeding part" for feeding ink from the counting tank 21 to the intermediate tank 22.

The pipe 43 connects the intermediate tank 22 and the at least one printer 9 for communication therebetween. An end of the pipe 43 which is closer to the intermediate tank 22 is the discharge port 220 of the intermediate tank 22. In the present preferred embodiment, two printers, i.e. the first printer 91 and the second printer 92, are used as the at least one printer 9, as mentioned above. Accordingly, the pipe 43 includes a pipe 430 which connects to the intermediate tank 22, a pipe 431 which connects the pipe 430 and the first printer 91 to each other, and a pipe 432 which connects the pipe 430 and the second printer 92 to each other.

The supply pump 32, a supply valve 54, the filter 23 and the deaeration module 24 are provided in the pipe 430 in the order named as seen from the intermediate tank 22.

In the present preferred embodiment, the pipe 43 serves as a "supply path" for supplying ink from the intermediate tank 22 to the at least one printer 9. Specifically, the pipe 430 and the pipe 431 serve as a supply path from the intermediate tank 22 to the first printer 91, and the pipe 430 and the pipe 432 serve as a supply path from the intermediate tank 22 to the second printer 92.

As shown in FIGS. 1 and 2, the first printer 91 includes a first printer controller 910, a first head tank 911 for supplying ink directly to an ink ejection head, and a first printer valve 912 for making and breaking a connection between the first head tank 911 and the liquid supply apparatus 1. The pipe 431 is connected for communication with the first head tank 911 through the first printer valve 912. The first printer controller 910 controls the first printer valve 912.

Likewise, the second printer 92 includes a second printer controller 920, a second head tank 921 for supplying ink directly to an ink ejection head, and a second printer valve 922 for making and breaking a connection between the second head tank 921 and the liquid supply apparatus 1. The pipe 432 is connected for communication with the second head tank 921 through the second printer valve 922. The second printer controller 920 controls the second printer valve 922.

As shown in FIG. 2, the controller 10 receives sensing signals from the low liquid level sensor 211 and the high liquid level sensor 212 of the counting tank 21 and from the first sensor 221 and the second sensor 222 of the intermediate tank 22. The controller 10 also receives ink supply request signals from the first printer controller 910 and the second printer controller 920. Specifically, the first printer controller 910 and the second printer controller 920 send connection making signals to the first printer valve 912 and the second printer valve 922 respectively, and at the same time send the request signals to the controller 10. The first printer controller 910 and the second printer controller 920 send connection breaking signals to the first printer valve 912 and the second printer valve 922 respectively, and at the same time stop the request signals to the controller 10.

The controller 10 is electrically connected to the suction pump 31, the supply pump 32, the suction valves 51 and 52, the discharge valve 53 and the supply valve 54. The controller 10 controls the operations of opening and closing the suction pump 31, the supply pump 32, the suction valves 51 and 52, the discharge valve 53 and the supply valve 54 in accordance with user's manipulations, various input signals or previously set programs.

The controller 10 is formed by, for example, a computer including a computation processor such as a CPU, and a memory. As shown in FIG. 2, the controller 10 includes a storage area 11 for storing a correspondence table 111 to be described later therein.

With the aforementioned configuration, the liquid supply apparatus 1 supplies ink from the at least one ink tank 8 to the at least one printer 9. The brief description of the operation of the liquid supply apparatus 1 is as follows.

First, the suction pump 31 is driven to supply ink from the at least one ink tank 8 through the pipe 41 to the counting tank 21. The ink temporarily stored in the counting tank 21 is discharged through the pipe 42 and the discharge valve 53 to the intermediate tank 22. The ink stored in the intermediate tank 22 is fed into the pipe 43 by the supply pump 32 in accordance with the request signal from the at least one printer 9. The ink fed by the supply pump 32 passes through the pipe 43 and then through the supply valve 54 to the filter 23, which in turn removes foreign matter from the ink. Then, the ink reaches the deaeration module 24, which in turn removes dissolved gases from the ink. Finally, the ink is supplied to the at least one printer 9.

The details of a configuration for suppressing an abrupt change in pressure in the at least one printer 9 which is a destination to which ink is supplied in such a liquid supply apparatus 1 will be described later.

<1-2. Counting Tank>

Figure 3:
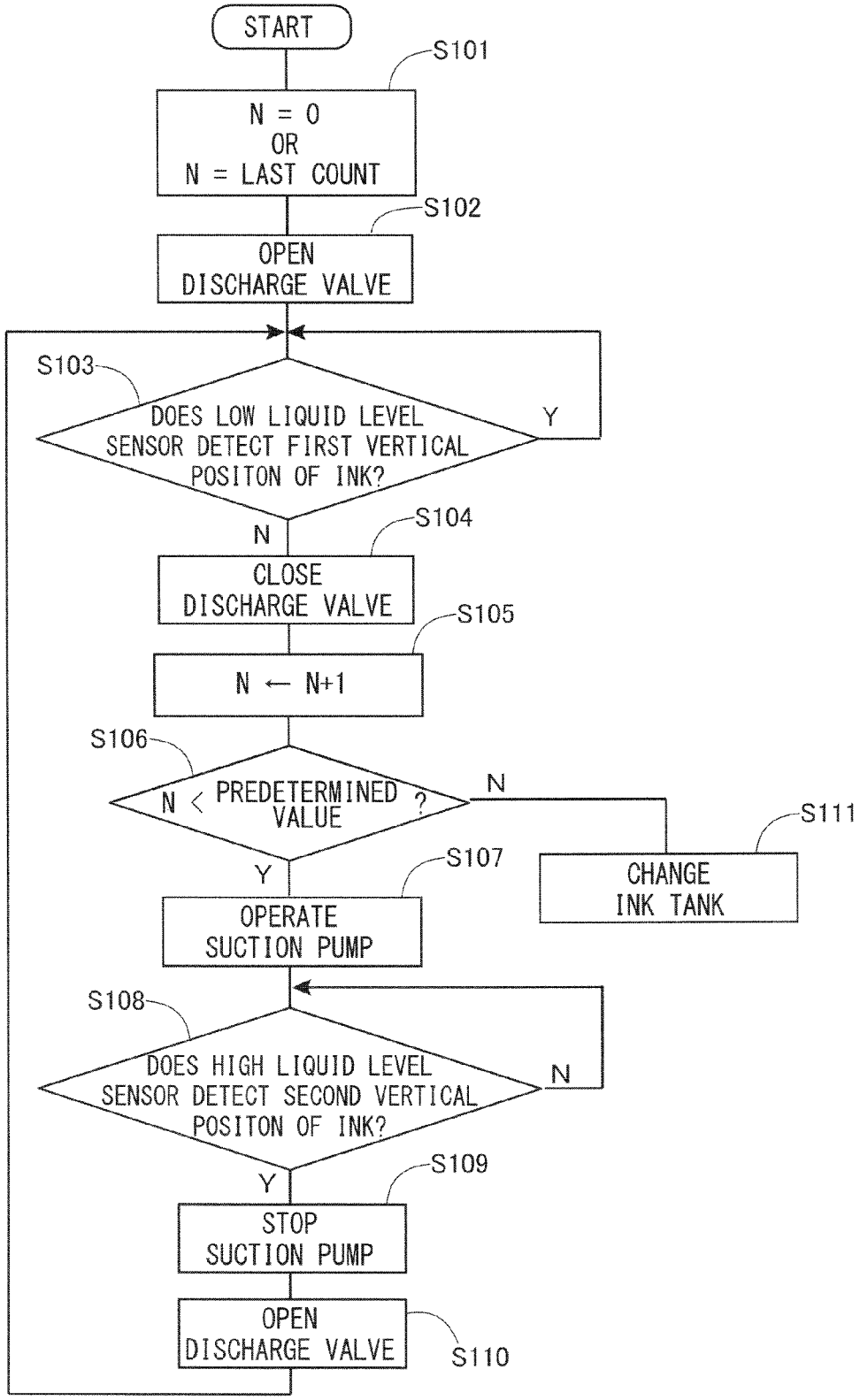
FIG. 3 is a flow diagram showing a procedure for measurement of the volume of ink in a counting tank.

Next, the measurement of the volume of ink in the counting tank 21 will be described. FIG. 3 is a flow diagram showing an example of a procedure for measurement of the volume of ink in the counting tank 21.

In the present preferred embodiment, 18 liters of ink is stored in each ink tank 8 before use. The counting tank 21 has an ink capacity of 100 milliliters from the first vertical position to the second vertical position. The ink capacity of the counting tank 21 from the first vertical position to the second vertical position shall be referred to simply as the ink capacity of the counting tank 21 hereinafter. It should be noted that the ink capacity of each ink tank 8 and the ink capacity of the counting tank 21 are not limited to the aforementioned values. The operation of the counting tank 21 and its adjacent components is described below.

As mentioned above, the counting tank 21 includes the low liquid level sensor 211 and the high liquid level sensor 212 which sense the liquid level of ink stored in the counting tank 21.

At the start of the operation of the liquid supply apparatus 1, the controller 10 initially checks a count N (in Step S101). The count N is treated as a variable in the computation process in the controller 10. The count N is zero when a new ink tank 8 is to be used. When the ink tank 8 used during the preceding operation is to be continuously used without change, the count N has the same value as that obtained at the completion of the preceding operation. For convenience of description, it is assumed that the ink tank 8 to be used in this case is the first ink tank 81. At this time, the suction pump 31 is unoperated, and the discharge valve 53 is closed. Also, the suction valve 51 which controls the communication between the first ink tank 81 to be used and the suction pump 31 is open, and the suction valve 52 which controls the communication between the second ink tank 82 not to be used and the suction pump 31 is closed.

Next, the controller 10 opens the discharge valve 53 to discharge the ink remaining in the counting tank 21 to the intermediate tank 22 (in Step S102). Then, the controller 10 judges whether the liquid level of ink in the counting tank 21 is higher than the aforementioned first vertical position or not, based on the sensing signal sent from the low liquid level sensor 211 (in Step S103). When the liquid level of ink in the counting tank 21 is higher than the first vertical position, the discharge of ink is continued, and the procedure returns to Step S103.

When the liquid level of ink in the counting tank 21 becomes lower than the first vertical position in Step S103, the controller 10 closes the discharge valve 53 (in Step S104). This stops the discharge of ink from the counting tank 21 to the intermediate tank 22.

Then, the controller 10 increases the value of the count N by one. That is, the controller 10 increments the count N (in Step S105). Then, the controller 10 judges whether the count N is less than a predetermined value or not (in Step S106). The predetermined value is a value determined by the ink capacity of the ink tank 8 to be used and the ink capacity of the counting tank 21. The predetermined value is less than the quotient of the ink capacity of the ink tank 8 divided by the ink capacity of the counting tank 21, and is preferably a greater value. In the present preferred embodiment, the predetermined value may be set to 178, for example, because the ink capacity of the ink tank 8 is 18 liters and the ink capacity of the counting tank 21 is 100 milliliters.

When the count N is not less than the predetermined value in Step S106, the procedure proceeds to Step S111 in which the ink tank 8 is changed. In the present preferred embodiment, the suction valve 51 is closed and the suction valve 52 is opened, whereby the ink tank 8 to be used is changed from the first ink tank 81 to the second ink tank 82. The change of the ink tank 8 may be done either manually or automatically by the controller 10. After the controller 10 automatically changes the ink tank 8, the count N may be reset to zero and the procedure may return to Step S106.

On the other hand, when the count N is less than the predetermined value in Step S106, the suction pump 31 is brought into operation (in Step S107). This causes the supply of ink from the ink tank 8 to the counting tank 21.

Subsequently, the controller 10 judges whether the liquid level of ink in the counting tank 21 is higher than the aforementioned second vertical position or not, based on the sensing signal sent from the high liquid level sensor 212 (in Step S108). When the liquid level of ink in the counting tank 21 is not higher than the second vertical position, the supply of ink is continued, and the procedure returns to Step S108.

When it is judged in Step S108 that the liquid level of ink in the counting tank 21 reaches the second vertical position, the suction pump 31 is stopped (in Step S109). This stops the supply of ink from the ink tank 8 to the counting tank 21.

Thereafter, the discharge valve 53 is opened to start the discharge of ink (in Step S110). Then, the procedure returns to Step S103.

Steps S104 to S107 in which the suction pump 31 is brought into operation and the discharge valve 53 is closed after the liquid level of ink in the counting tank 21 becomes lower than the first vertical position shall be collectively referred to as a first process. Steps S109 to S110 in which the suction pump 31 is stopped and the discharge valve 53 is opened after the liquid level of ink in the counting tank 21 reaches the second vertical position shall be collectively referred to as a second process. The controller 10 repeats the first process and the second process to measure the number of repetitions by incrementing the count N in Step S105. Then, the controller 10 estimates the volume of ink supplied from the ink tank 8 to the intermediate tank 22, based on the count N, thereby to estimate the volume of ink remaining in the ink tank 8 being used. As a result, before the volume of ink remaining in the ink tank 8 becomes zero, the change to another ink tank 8 is done to prevent a situation such that ink can no longer be supplied to the counting tank 21. Also, the entry of air into the pipe 41 is suppressed.

While the liquid level of ink in the intermediate tank 22 is higher than the second sensor 222 in Steps S102 and S110, the opening of the discharge valve 53 may be temporarily stopped.

<1-3. Operation of Supply Pump>

Figure 4:
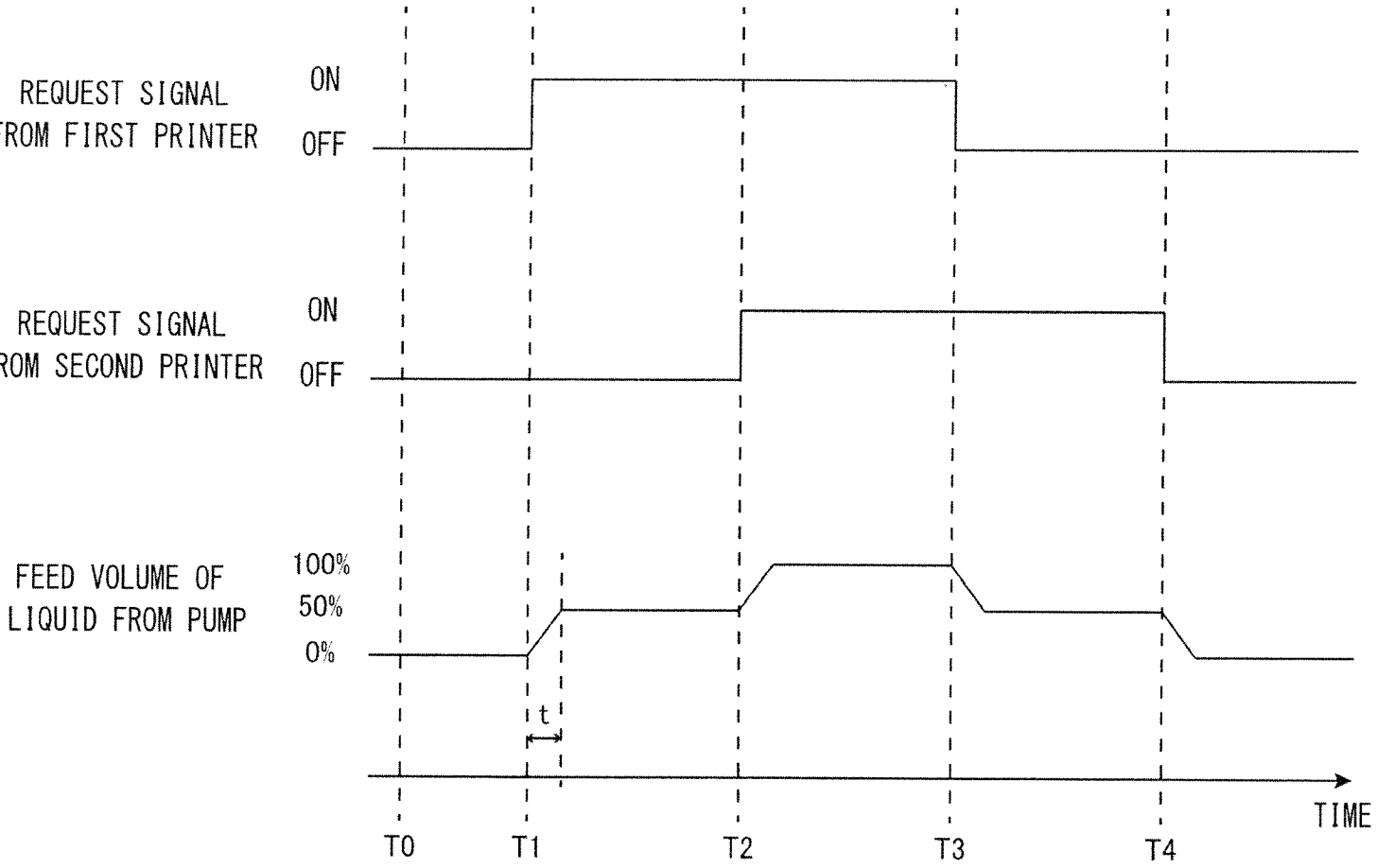
FIG. 4 is a graph showing an example of a relationship between request signals from printers and an output from a supply pump.
Figure 5:
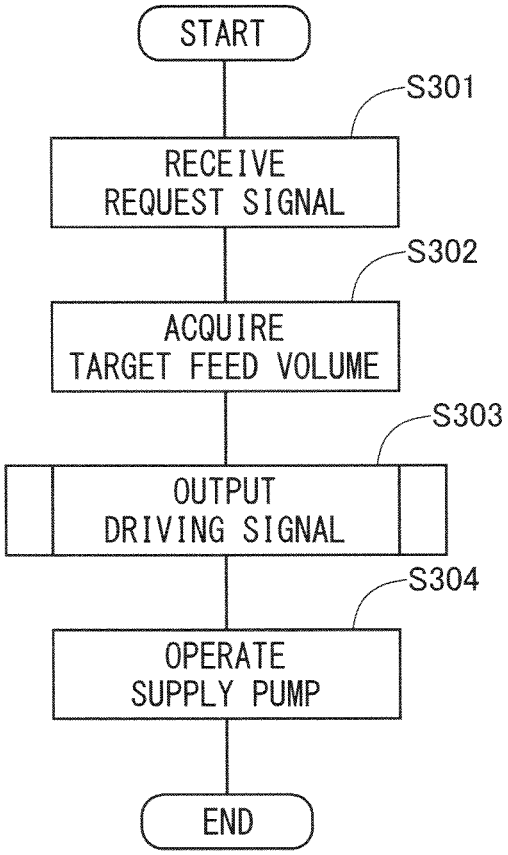
FIG. 5 is a flow diagram showing a procedure for operation of the supply pump in response to the request signals from the printers.

Next, the operation of the supply pump 32 will be described. FIG. 4 is a graph showing an example of a relationship between the request signals from the two printers 9 and the feed volume of the liquid from the supply pump 32 (the feed volume of the liquid per unit time; the same shall apply hereinafter). FIG. 5 is a flow diagram showing a procedure for operation of the supply pump 32 in response to the request signals from the two printers 9. The abscissa of FIG. 4 represents time which is common to upper, middle and lower parts of FIG. 4. The upper part of FIG. 4 represents a request signal 91P from the first printer 91; the middle part thereof represents a request signal 92P from the second printer 92; and the lower part thereof represents the feed volume W of the liquid from the supply pump 32.

In the present preferred embodiment, assuming that the maximum feed volume of the liquid from the supply pump 32 is 100%, the supply pump 32 supplies ink in a feed volume W of 50% to the first printer 91, and supplies ink in a feed volume W of 50% to the second printer 92.

At time T0 in the example of FIG. 4, the request signal 91P and the request signal 92P are OFF, and the operation starts when the supply pump 32 is in a stopped state. Thereafter, the request signal 91P is turned ON at time T1, and the signal 92P is subsequently turned ON at time T2. Then, the request signal 91P is turned OFF at time T3, and the request signal 92P is turned OFF at time T4. Changes in the feed volume W of the liquid from the supply pump 32 in this operation will be described with reference to FIG. 5.

First, the request signal 91P is turned ON at the time T1. In other words, the controller 10 receives the request signal 91P (in Step S301).

Next, the controller 10 acquires the target feed volume Wg of the liquid from the supply pump 32, based on the received request signal 91P (in Step S302). In the present preferred embodiment, the target feed volume Wg of the liquid which is 50% is acquired because the feed volume W of the liquid to the first printer 91 is 50% of the maximum feed volume.

Then, the controller 10 sends a driving signal S to the supply pump 32, based on the acquired target feed volume Wg (in Step S303). Subsequently, the supply pump 32 operates, based on the received driving signal S (in Step S304). Specifically, the supply pump 32 feeds the liquid in accordance with the output of the driving signal S. In response to the driving signal S, the supply pump 32 gradually changes the feed volume W from a current feed volume Wn of 0% to a target feed volume Wg of 50%. In the example of FIG. 4, the feed volume W gradually increases from the time T1 at which the request signal 91P is received, and reaches a target feed volume Wg of 50% after a lapse of time t. A procedure during the output of the driving signal S in Step S303 will be described later.

Likewise, when the request signal 92P is turned ON at the time T2, the controller 10 acquires a target feed volume Wg of 100%. The feed volume W of the liquid from the supply pump 32 gradually changes from 50% to 100%. Next, when the request signal 91P is turned OFF at the time T3, the controller 10 acquires a target feed volume Wg of 50%. The feed volume W of the liquid from the supply pump 32 gradually changes from 100% to 50%. When the request signal 92P is turned OFF at the time T4, the controller 10 acquires a target feed volume Wg of 0%. The feed volume W of the liquid from the supply pump 32 gradually changes from 50% to 0%.

Gradually changing the feed volume W of the liquid from the supply pump 32 in this manner suppresses an abrupt change in pressure in the printers 9 which is a destination to which ink is supplied.

<1-4. Driving Signal>

Figure 6:
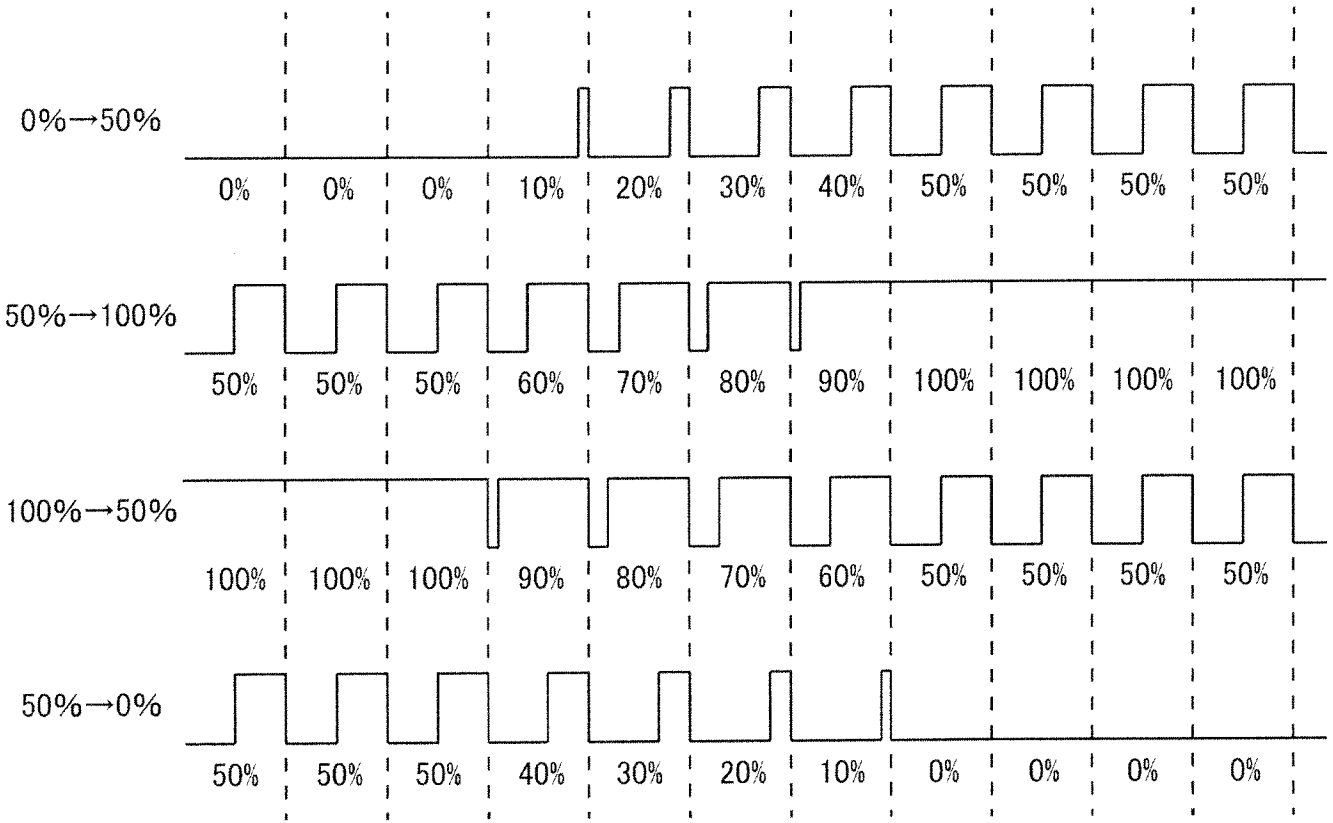
FIG. 6 is a graph showing waveforms of a driving signal during changes in output.
Figure 8:
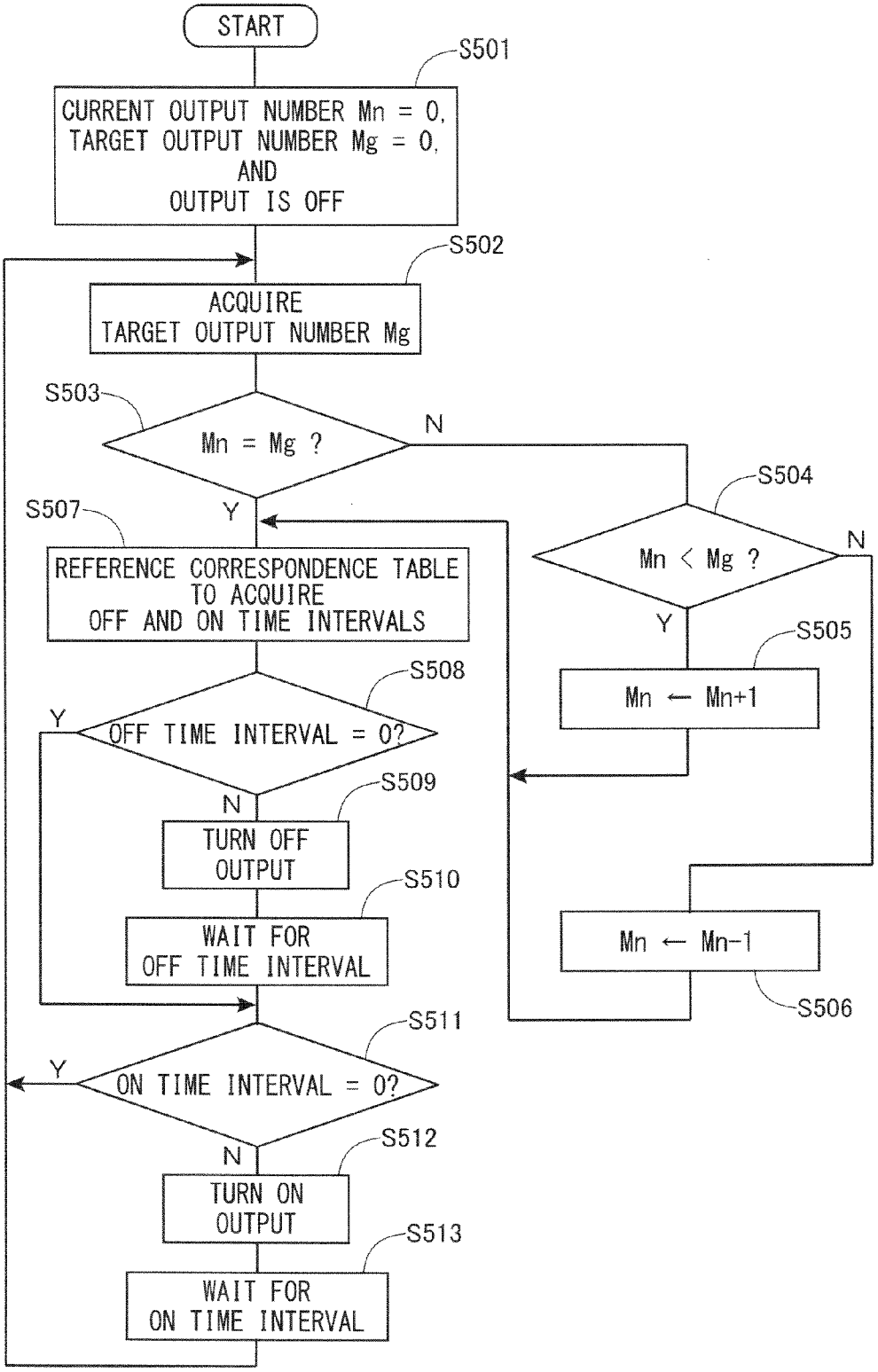
FIG. 8 is a flow diagram showing a procedure during the output of the driving signal.

Next, the driving signal S sent from the controller 10 to the supply pump 32 will be described. FIG. 6 is a graph showing waveforms of the driving signal S during changes in output. FIG. 7 shows the correspondence table 111 between the output number of the driving signal S and a duty ratio. FIG. 8 is a flow diagram showing a procedure in the controller 10 during the output of the driving signal S.

In the present preferred embodiment, the operation of the supply pump 32 is under PWM (pulse width modulation) control. Specifically, the driving signal S sent from the controller 10 to the supply pump 32 is in the form of a rectangular pulse wave whose high state voltage is constant. The pulse wave has a constant frequency and a pulse width with a variable duty ratio D. Thus, the output of the driving signal S in the present preferred embodiment is the duty ratio D of the pulse width.

The feed volume W of the liquid from the supply pump 32 depends on the driving signal S inputted thereto. In other words, the feed volume W of the liquid from the supply pump 32 varies in corresponding relation to the duty ratio D of the driving signal S. In the present preferred embodiment, the feed volume W of the liquid from the supply pump 32 and the duty ratio D of the driving signal S are in the following corresponding relation: D=0% for W=0%; D=50% for W=50%; and D=100% for W=100%.

FIG. 6 shows an example of the driving signal S in the case where the driving signal S is gradually changed from an initial output to a target output. The abscissa of FIG. 6 represents time. The driving signal S shown in FIG. 6 is that obtained in the case where the duty ratio D is changed from 0% to 50%, from 50% to 100%, from 100% to 50%, and from 50% to 0% in top-to-bottom order. In the example of FIG. 6, the duty ratio D of the driving signal S changes stepwise from the initial output to the target output in steps of 10%.

FIG. 7 shows the correspondence table 111 between the output number M of the driving signal and the duty ratio D. The values of the output number M, and the values of the duty ratio D, an OFF time interval and an ON time interval corresponding to the output number M are listed in the correspondence table 111. In the present preferred embodiment, the driving signal S has a period of 10 ms, the sum of the OFF time interval and the ON time interval per period is 10 ms. A procedure using the correspondence table 111 during the output of the driving signal S will be described below with reference to FIG. 8.

At the start of driving of the liquid supply apparatus 1, the supply pump 32 is not driven, so that the feed volume W of the liquid from the supply pump 32 is 0%. At this time, the controller 10 does not send the driving signal S, so that the duty ratio D of the driving signal S is 0%. When the liquid supply apparatus 1 is driven, the controller 10 sets a current output number Mn and a target output number Mg to zero in corresponding relation to a duty ratio D of 0% (in Step S501). At this time, the output of the driving signal S is OFF.

Next, the controller 10 acquires the target output number Mg corresponding to a target duty ratio, based on the target feed volume Wg of the liquid from the supply pump 32 acquired in Step S302 described above (in Step S502).

Then, the controller 10 judges whether the current output number Mn coincides with the target output number Mg or not (in Step S503). When the current output number Mn coincides with the target output number Mg, the procedure proceeds to Step S507.

When the current output number Mn does not coincide with the target output number Mg, the controller 10 judges whether the current output number Mn is less than the target output number Mg or not (in Step S504). When the current output number Mn is less than the target output number Mg, the value of the current output number Mn is increased by one. That is, the current output number Mn is incremented (in Step S505). Then, the procedure proceeds to Step S507. On the other hand, when the current output number Mn is greater than the target output number Mg, the value of the current output number Mn is decreased by one. That is, the current output number Mn is decremented (in Step S506). Then, the procedure proceeds to Step S507.

In Step S507, the controller 10 references the correspondence table 111 stored in the storage area 11 to acquire the OFF and ON time intervals corresponding to the current output number Mn.

Subsequently, the controller 10 judges whether the acquired OFF time interval is zero or not (in Step S508). When the acquired OFF time interval is zero, the procedure proceeds to Step S511. When the acquired OFF time interval is not zero, the controller 10 turns OFF the output of the driving signal S (in Step S509), and waits for the acquired OFF time interval (in Step S510).

Then, the controller 10 judges whether the acquired ON time interval is zero or not (in Step S511). When the acquired ON time interval is zero, the procedure returns to Step S502. When the acquired ON time interval is not zero, the controller 10 turns ON the output of the driving signal S (in Step S512), and waits for the acquired ON time interval (in Step S513). Then, the procedure returns to Step S502.

Using the aforementioned procedure, the controller 10 changes the driving signal S in the form of a pulse wave while acquiring the duty ratio D by reference to the correspondence table 111. Specifically, the controller 10 acquires the target duty ratio and the target output number Mg corresponding to the target feed volume Wg, based on the request signal from the at least one printer 9 to change the duty ratio D of the driving signal S stepwise from the current duty ratio to the target duty ratio. In the present preferred embodiment, the duty ratio D of the driving signal S changes stepwise in steps of 10%, as shown in FIG. 6. This gradually changes the feed volume W of the liquid from the supply pump 32. As a result, an abrupt change in pressure in the at least one printer 9 which is a destination to which ink is supplied is suppressed.

In the aforementioned example, the duty ratio D of the driving signal S is changed for each period of a pulse. The present invention, however, is not limited to this. The duty ratio D of the driving signal S may be changed for each group of periods. This changes the feed volume W of the liquid from the supply pump 32 more slowly to further suppress an abrupt change in pressure in the at least one printer 9 which is a destination to which ink is supplied.

2. Modification

While the one preferred embodiment according to the present invention has been described hereinabove, the present invention is not limited to the aforementioned preferred embodiment.

In the aforementioned preferred embodiment, the required feed volume of the liquid from the supply pump 32 to the first printer 91 is 50%, and the required feed volume of the liquid from the supply pump 32 to the second printer 92 is 50%. The present invention, however, is not limited to this. When the at least one printer 9 includes a plurality of printers 9, the required feed volumes different from each other may be set for the respective printers 9. In this case, the maximum value of the target feed volume of the liquid from the supply pump 32 is the sum of the required feed volumes of the liquid to the respective printers 9. Also, the target feed volume is the sum of the required feed volumes of the liquid to the respective printers 9 outputting the request signals. This achieves the supply of ink in appropriate volumes to the respective printers 9.

The required feed volumes of the liquid to the printers 9 may correspond to the lengths of the supply paths to the printers 9, respectively. For example, when the total length of the pipes 430 and 431 serving as the supply path to the first printer 91 is shorter than the total length of the pipes 430 and 432 serving as the supply path to the second printer 92, the required feed volume of the liquid to the first printer 91 may be less than the required feed volume of the liquid to the second printer 92.

The controller 10 may vary the feed volume of the liquid from the suction pump 31, based on the request signals from the printers 9. For example, the controller 10 may control the suction pump 31 so that the greater the number of printers 9 outputting the request signals or the target feed volume is, the greater the feed volume of the liquid from the suction pump 31 is. This allows the volume of ink in the intermediate tank 22 to be maintained at an appropriate volume.

In the aforementioned preferred embodiment, the duty ratio D of the driving signal S is changed in steps of 10%. The present invention, however, is not limited to this. The duty ratio D may be changed in steps of 5%, 1% or less than 1%. Similarly, the number of steps of the duty ratio D of the driving signal S for one printer 9 is five in the aforementioned preferred embodiment. The present invention, however, is not limited to this. The number of steps of the duty ratio D for one printer 9 may be less than or more than five. Also, when the at least one printer 9 includes a plurality of printers 9, the number of steps of the duty ratio D may be set for each of the printers 9.

In the aforementioned preferred embodiment, the driving signal S has a period of 10 ms, i.e. a frequency of 0.1 kHz. The present invention, however, is not limited to this. The driving signal S may have a frequency of 1 kHz, for example. An appropriate frequency may be used as the frequency of the driving signal S, as required, in accordance with the output from the liquid supply apparatus 1 and the like.

In the aforementioned preferred embodiment, the controller 10 uses the PWM control to control the operation of the supply pump 32. The present invention, however, is not limited to this. The controller 10 may control the operation of the supply pump 32 by changing the driving voltage stepwise, in place of the PWM control. The PWM control is, however, preferable in being able to change the output while maintaining a rated voltage suitable for the driving of the supply pump 32.

The configurations of the details of the liquid supply apparatus may differ from those shown in the figures of the present invention. The components described in the aforementioned preferred embodiment and in the various modifications may be consistently combined together, as appropriate.

The liquid supply apparatus according to the present invention is not limited to an ink supply apparatus for a printer, but may be, for example, an apparatus for supplying a treatment liquid to an apparatus (a liquid consuming apparatus) which applies the treatment liquid to surfaces of a semiconductor substrate and a substrate for a flat panel display device.

While the invention has been described in detail, the foregoing description is in all aspects illustrative and not restrictive. It is understood that numerous other modifications and variations can be devised without departing from the scope of the invention.

What is claimed is:

1. A liquid supply apparatus for supplying a liquid to at least one liquid consuming apparatus, said liquid supply apparatus comprising:

a reservoir for storing a liquid therein;

a supply path for supplying said liquid from said reservoir to said liquid consuming apparatus;

a pump for feeding said liquid from said reservoir to said supply path; and a controller for outputting a driving signal to said pump to control the supply of said liquid, said controller acquiring a target feed volume of said liquid from said pump to gradually change a feed volume of said liquid from said pump from a current feed volume to said target feed volume, based on a request signal from said liquid consuming apparatus.

2. The liquid supply apparatus according to claim 1, wherein said controller acquires a target output of said driving signal corresponding to said target feed volume, based on said request signal, to change said driving signal stepwise from a current output to said target output.

3. The liquid supply apparatus according to claim 2, wherein:

said driving signal is in the form of a rectangular pulse wave whose high state voltage is constant;

said output is a duty ratio of a pulse width of said pulse wave;

the feed volume of said liquid from said pump corresponds to said duty ratio; and said controller acquires a target duty ratio corresponding to said target feed volume, based on said request signal, to change said pulse width stepwise from a current duty ratio to said target duty ratio.

4. The liquid supply apparatus according to claim 3, wherein:

said controller includes a storage area for storing therein a table listing the values of said duty ratio; and said controller references said table to change said pulse wave while acquiring the values of said duty ratio.

5. The liquid supply apparatus according to claim 1, further comprising:

a counting tank for managing the feed volume of said liquid;

a first feeding part for feeding said liquid from a supply tank of said liquid to said counting tank; and a second feeding part for feeding said liquid from said counting tank to said reservoir, said counting tank including a low liquid level sensor for sensing whether the liquid level of said liquid stored in the counting tank is higher than a predetermined first vertical position or not, and a high liquid level sensor for sensing whether the liquid level of said liquid stored in the counting tank is higher than a second vertical position or not, said second vertical position being higher than said first vertical position, wherein, when the liquid level of said liquid in said counting tank becomes lower than said first vertical position, said controller stops said second feeding part and operates said first feeding part to cause said first feeding part to supply said liquid from said supply tank into said counting tank, based on sensing signals from said high liquid level sensor and said low liquid level sensor, wherein, when the liquid level of said liquid in said counting tank reaches said second vertical position, said controller stops said first feeding part and operates said second feeding part to cause said second feeding part to discharge said liquid from said counting tank to said reservoir, based on said sensing signals, and wherein, said controller estimates the supply volume of said liquid from said supply tank to said reservoir, based on the number of times of the supply and discharge of said liquid to and from said counting tank.

6. The liquid supply apparatus according to claim 5, wherein said controller varies the feed volume of said liquid from said first feeding part, based on said request signal.

7. The liquid supply apparatus according to claim 1, wherein said at least one liquid consuming apparatus includes a plurality of liquid consuming apparatuses, said liquid supply apparatus supplying said liquid to said liquid consuming apparatuses.

8. The liquid supply apparatus according to claim 7, wherein:

the maximum value of said target feed volume of said liquid from said pump is the sum of the required feed volumes of said liquid to said liquid consuming apparatuses; and said target feed volume is the sum of the required feed volumes of said liquid to said liquid consuming apparatuses outputting said request signal.

9. The liquid supply apparatus according to claim 8, wherein the required feed volumes of said liquid to said liquid consuming apparatuses correspond to the lengths of said supply paths to said liquid consuming apparatuses, respectively.

10. A method of supplying a liquid to a liquid consuming apparatus, comprising the steps of:

a) providing a request signal from said liquid consuming apparatus to a controller which controls a pump for feeding a liquid stored in a reservoir to said liquid consuming apparatus;

b) providing a target feed volume of said liquid from said pump, to said controller, based on said request signal; and c) outputting a driving signal from said controller to said pump, said driving signal gradually changing a feed volume of said liquid from said pump from a current feed volume to said target feed volume.

11. The method according to claim 10, wherein:

said controller acquires a target output of said driving signal corresponding to said target feed volume, based on said request signal, in said step b); and said controller changes said driving signal stepwise from a current output to said target output in said step c).

12. The method according to claim 11, wherein:

said driving signal is in the form of a rectangular pulse wave whose high state voltage is constant;

said output is a duty ratio of a pulse width of said pulse wave;

the feed volume of said liquid from said pump corresponds to said duty ratio;

said controller acquires a target duty ratio corresponding to said target feed volume, based on said request signal, in said step b); and said controller changes said pulse width stepwise from a current duty ratio to said target duty ratio in said step c).

13. The method according to claim 12, wherein:

said controller includes a storage area for storing therein a table listing the values of said duty ratio; and said controller references said table to acquire the values of said duty ratio in said step b).

14. The method according to claim 10, wherein:

a first process includes operating a first feeding part for feeding said liquid from a supply tank of said liquid to a counting tank and stopping a second feeding part for feeding said liquid from said counting tank to said reservoir, after the liquid level of said liquid stored in said counting tank becomes lower than a predetermined first vertical position;

a second process includes stopping said first feeding part and operating said second feeding part, after the liquid level of said liquid stored in said counting tank reaches a second vertical position higher than said first vertical position;

said first process and said second process are repeated; and the supply volume of said liquid from said supply tank to said reservoir is estimated by measuring the number of times of said first process and said second process.

15. The method according to claim 14, wherein said controller varies the feed volume of said liquid from said first feeding part, based on said request signal.

* * * * *